US005501044A

United States Patent [19]

Janesky

[11] Patent Number: 5,501,044

[45] Date of Patent: Mar. 26, 1996

[54] SUB-FLOOR DRAIN CONDUIT FOR WATER-CONTROL SYSTEMS

[76] Inventor: Lawrence M. Janesky, 11 Fawn Meadow La., Huntington, Conn. 06484

[21] Appl. No.: 298,937

[22] Filed: Aug. 31, 1994

[51] Int. Cl.[6] ..... E04B 1/70; E02D 19/00

[52] U.S. Cl. ..... 52/169.5; 52/302.3; 52/287.1; 404/4; 405/39; 405/43; 405/45

[58] Field of Search ..... 52/169.5, 302.3, 52/169.13, 169.14, 287.1; 404/3, 4; 405/39, 43, 45

[56] References Cited

U.S. PATENT DOCUMENTS

| | | | |
|---|---|---|---|
| 3,283,460 | 11/1966 | Patrick | 52/169.5 X |
| 3,344,569 | 10/1967 | Cotten | 52/287.1 |
| 3,850,193 | 11/1974 | Guzzo | 52/169.5 X |
| 4,245,443 | 1/1981 | Beechen | 52/169.5 |
| 4,265,064 | 5/1981 | Parezo | 52/169.5 |
| 4,590,722 | 5/1986 | Bevelacqua | 52/169.5 |
| 4,660,333 | 4/1987 | Romer | 52/169.5 |
| 4,745,716 | 5/1988 | Kuypers | 52/169.5 |
| 4,869,032 | 9/1989 | Geske | 52/302.3 |
| 4,879,851 | 11/1989 | Boccia | 52/169.5 |
| 4,930,272 | 6/1990 | Bevelacqua | 405/43 X |
| 5,199,232 | 4/1993 | Chandler et al. | 52/169.5 |

*Primary Examiner*—Robert J. Canfield
*Attorney, Agent, or Firm*—Perman & Green

[57] ABSTRACT

A sub-floor water control drainage conduit element and system which minimizes installation labor, materials and time. The drainage conduit element comprises an elongate conduit section which is somewhat hemispherical or somewhat-rectangular in cross-section and has a flat base on floor wall, and a roof wall and/or sidewall. The floor wall is designed to be supported on the top surface of a footing at the wall-footing interface or in an excavation at the base of a wall. The conduit section is open to admit groundwater, such as from the wall-footing interface, and the element contains an upper vertical wall portion which is designed to extend above the basement floor surface and is spaced from the basement wall to provide a wall drain gap down to the conduit section.

14 Claims, 3 Drawing Sheets

SUB-FLOOR DRAIN CONDUIT FOR WATER-CONTROL SYSTEMS

BACKGROUND OF THE INVENTION

1. Field of the Invention

The present invention relates to improvements in sub-floor water-control systems for receiving, channeling, collecting and expelling ground water from beneath the floor of basements or other subterranean rooms having walls and a floor. The problems caused by the invasion of ground water into basements and other structures are numerous. Generally such water seeps into basements from the walls and perimeter of the floor at the floor-wall joints, and/or through floor cracks, due to external hydrostatic pressures of water in the ground.

2. State of the Art

There are basically two known types of basement water control systems in use for perimeter-of-floor installation. According to one system, a sub-floor water conduit is installed below the floor and alongside the inside vertical wall of the footing surrounded by drainage space or gravel and open to the joint between the wall and footing. This method however requires a large amount of jackhammering, excavation and the hauling of heavy materials to and from the job, as a typical excavation for such a sub-floor system is 12"–14" wide and 10"–12" deep. This labor-intensive work increases the installation cost for such systems. Another problem with such a system, where a perforated pipe or conduit surrounded by crushed stone sits in the soil below the floor, is the infiltration of silt and soil into the stone and pipe which can clog the system and retard drainage. Additionally, a separate means must be incorporated for allowing water to run down the inside surface of the basement wall and enter the drain pipe or conduit below the floor. Various means are designed for this purpose, but they are not always used and, depending on which means is used, it can have disadvantages.

According to a known baseboard water control system, as disclosed in my U.S. Pat. No. 5,314,313, a plurality of weep holes are drilled into the wall, above the floor, along the area of the floor-wall joint if the walls are hollow core masonry block walls, around the inner periphery of a basement or other subterranean room, to admit any exterior groundwater accumulation as it occurs and prevent the build-up of hydrostatic pressure. A continuous, flexible, plastic, water-channelling baseboard enclosure is bonded to the surface of the floor to enclose the floor-wall joint around the inner periphery of the room, to control the ground water admitted through the weep holes or entering at the concrete wall-footing interface and channel and drain it into a collection location, such as a sump pump reservoir, from which it is pumped automatically to an exterior drain.

Such water-control systems produce excellent results but in some installations the presence and/or appearance of the above-floor baseboard enclosure is objectionable. Also their effectiveness is dependent upon the integrity of the bond between the plastic baseboard water-channeling enclosure the supporting floor. The said bond, generally by means of an epoxy resin, must provide a continuous water barrier. Otherwise water will leak out of the baseboard enclosure onto the basement floor. In some cases the concrete floor has a poor quality surface which is soft, too thin, severely cracked, etc. and is not suitable for bonding to a baseboard water control enclosure.

As discussed supra, sub-floor water control systems are known, and reference is made to U.S. Pat. Nos. 3,852,925; 4,590,722; 4,745,716 and 4,879,851 which disclose perimeter-of-wall water control systems in which drain tiles, drain conduits or perforated pipes are contained within a peripheral drainage ditch beneath the floor along the inside vertical wall surface of the footing. The sub-floor systems have the advantage of being concealed beneath the floor but the disadvantages of requiring substantial peripheral floor excavation to a depth below the upper surface of the wall footing and the labor-intensive requirements thereof.

The known sub-floor water control systems, as illustrated by the aforementioned patents, require substantial excavation of a drainage ditch installation since the drain tile, conduit or perforated pipe is buried usually in a gravel fill along the inside wall of the footing and below the upper surface or top of the footing. The drain tile, conduit or perforated pipe contains drain openings located well below the upper surface or top of the footing and therefore does not receive and move water to a discharge location until the water fills the drainage ditch and gravel fills so as to enter and flow through the tile, conduit or pipe. Also, the wall-draining means is separate from the conduit section and must be supported and aligned in a separate operation.

There is a need for a sub-floor water control system which is easier and less expensive to install, requires less floor excavation and gravel fill, and which receives and moves water to a discharge location immediately after entry of the water through or beneath the wall, and at a location above the footing, to reduce unnecessary labor expense to excavate lower than the top of the footing.

SUMMARY OF THE INVENTION

The present invention relates to a novel sub-floor basement water control system and to novel elongate water-receiving conduit enclosures or housings designed to be installed at the wall-footing interface, beneath a narrow peripheral area of a basement floor, and being open to receive water admitted through bore holes in a concrete block wall, and water that enters through the joint between the wall and footing, and water that enters through openings on the inside surface of the wall such as cracks, holes, and the porosity of the masonry wall itself, and to move such water to a drain location such as a sump pump or floor drain for discharge.

The present conduit enclosures or housings preferably are molded of plastic, such as PVC, and have a vertical upper wall portion carrying spacer members for spacing said portion from the basement wall to admit water therebetween and a lower conduit section extending outwardly and downwardly from the upper wall portion down to the wall footing and inwardly towards the base of the wall to form between the concrete floor, the footing and the base of the wall, a conduit for substantially retaining admitted water against drainage down beside the wall footing by conveying said water peripherally over the wall footing to one or more drainage conduits open to drain holes in the base wall of the conduit section.

The conduit section of the present enclosures may be somewhat-hemispherical so as to be completely open to the admission of water at the wall-footing interface, but preferably are somewhat-rectangular in cross-section, having a flat horizontal bottom or base wall section for supportive engagement with the upper surface or top of a conventional wall footing, and a vertical inside wall section having a lower portion which tapers down to said undersurface and is provided with a plurality of spaced openings or holes for admitting ground water to the conduit section.

The inside wall of the present conduit enclosures, designed to face the basement wall, has an integral upper vertical wall section which extends above the surface of the basement floor and contains stand-off or spacer means for engagement with the basement wall to provide therebetween a narrow vertical drainage space which enables any water from condensation, wall cracks or other inside wall seepage to drain or run down the interior surface of the basement wall, behind the upper vertical wall section, and enter the drainage conduit section for removal and discharge.

Other embodiments, features and advantages of the present sub-floor water drainage system and conduits will be apparent to those skilled in the art in light of the present disclosure including the drawings.

THE DRAWINGS

DETAILED DESCRIPTION OF THE PREFERRED EMBODIMENT

Figure 1:
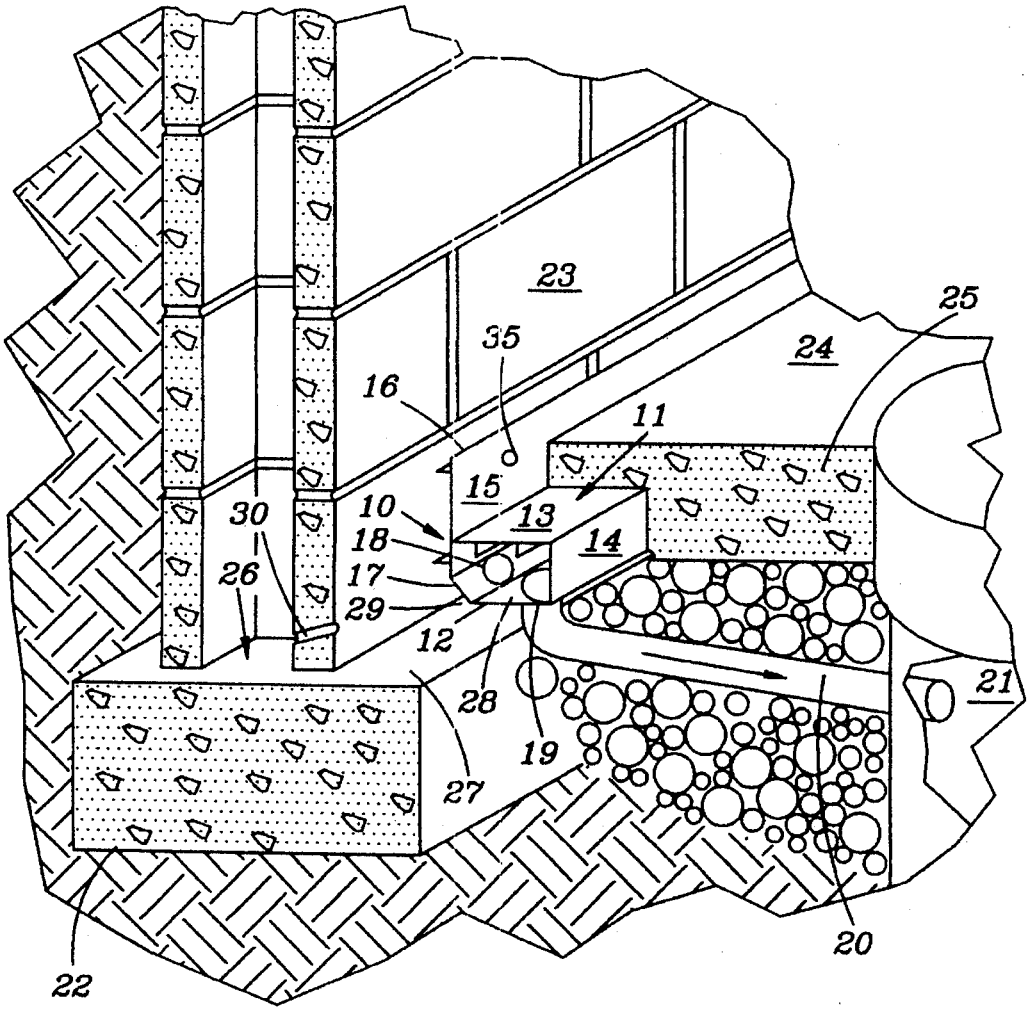
FIG. 1 is a perspective view of a section of a sub-floor water control installation according to a preferred embodiment of the present invention, illustrating a section of a drainage outlet means from the present tubular conduit section to a sump pump enclosure.

Referring to the embodiment of FIG. 1 of the drawings, the present water-receiving, water-moving sub-floor drainage conduit 10 comprises a somewhat-rectangular elongate tubular conduit section 11 having a horizontal base floor wall 12, a horizontal top or roof wall 13, an outer wall 14 having a vertical upper portion and a lower portion **14*a* inclined toward the center of the drainage conduit, and an inner wall 15 having a vertical upper wall portion 16 and an inwardly inclined lower wall portion 17 which is provided with a plurality of water-inlet openings 18, spaced along the length of the inclined lower wall portion 17, such as at 3" intervals. The illustrated section of drainage conduit 10 has a floor drain 19 to a drain pipe 20 opening into a sump pump enclosure 21. The elongate drainage conduit 10, consisting of united lengths of such conduit, has one such floor drain 19** to which trapped water flows by gravity for discharge to a remote location.

FIG. 1 illustrates the installation location of the present drainage conduit 10 at the interface between the foundation or footing 22 of the walls 23 and the base of a concrete block wall 23, below the upper surface 24 of the concrete floor 25 of a basement or other subterranean room. The footing 22 has a flat, horizontal upper surface 26, which supports the wall 23, and which has inner and outer ledges which extend beyond the wall 23. The inner ledge 27 engages the bottom wall 12 and supports the drainage conduit 10, and an inner edge portion 28 of the ledge 27 is notched to accommodate the neck of the drain pipe 20 and enable the drainage conduit 10 to lie flat against the surface of the ledge 27.

As illustrated, the outer face of the inclined lower wall portion 17 of the drainage conduit 10 forms between itself and the wall-ledge interface an elongate water passage 29 of triangular cross-section which is open to wall bores 30, a spaced plurality of which are drilled into the concrete block wall 23 adjacent the wall-ledge interface, and is also open to the water inlet holes 18 spaced along the inclined wall portion 17 of the conduit 10.

The opposed vertical wall 14 of the drainage conduit 10 includes a lower wall section **14*a*** that is sloped downwardly and inwardly toward the center of the drain. This shape facilitates an easier installation in that the drainage conduits will more easily conform to a roughly jackhammered excavation in the concrete floor which will tend to be sloped towards its center.

The wall bores 30 are spaced every 4 to 8 inches along the base of the concrete block wall 23 to admit exterior groundwater from each block interior space and relieve hydrostatic pressure. The incoming water flows through the triangular water passage 29, over the surface of the footing ledge 27, and enters the tubular section 11 of the drainage conduit 10 through the nearest water-inlet openings 18 for gravity flow to the floor drain 19 and into the sump pump enclosure 21. Openings 18 preferably are spaced from each other by about 3" and have a diameter of about ¾". In the case of poured concrete walls rather than concrete block walls 23, as illustrated in FIG. 1, no bore holes 30 are drilled since the incoming groundwater enters between the base of the wall and the upper surface of the footing. With concrete block walls 23, the concrete blocks are hollow with 2 or 3 vertical air spaces into which ground water can penetrate, and a bore 30 is drilled into each air space to relieve the hydrostatic pressure therewithin.

Figure 2:
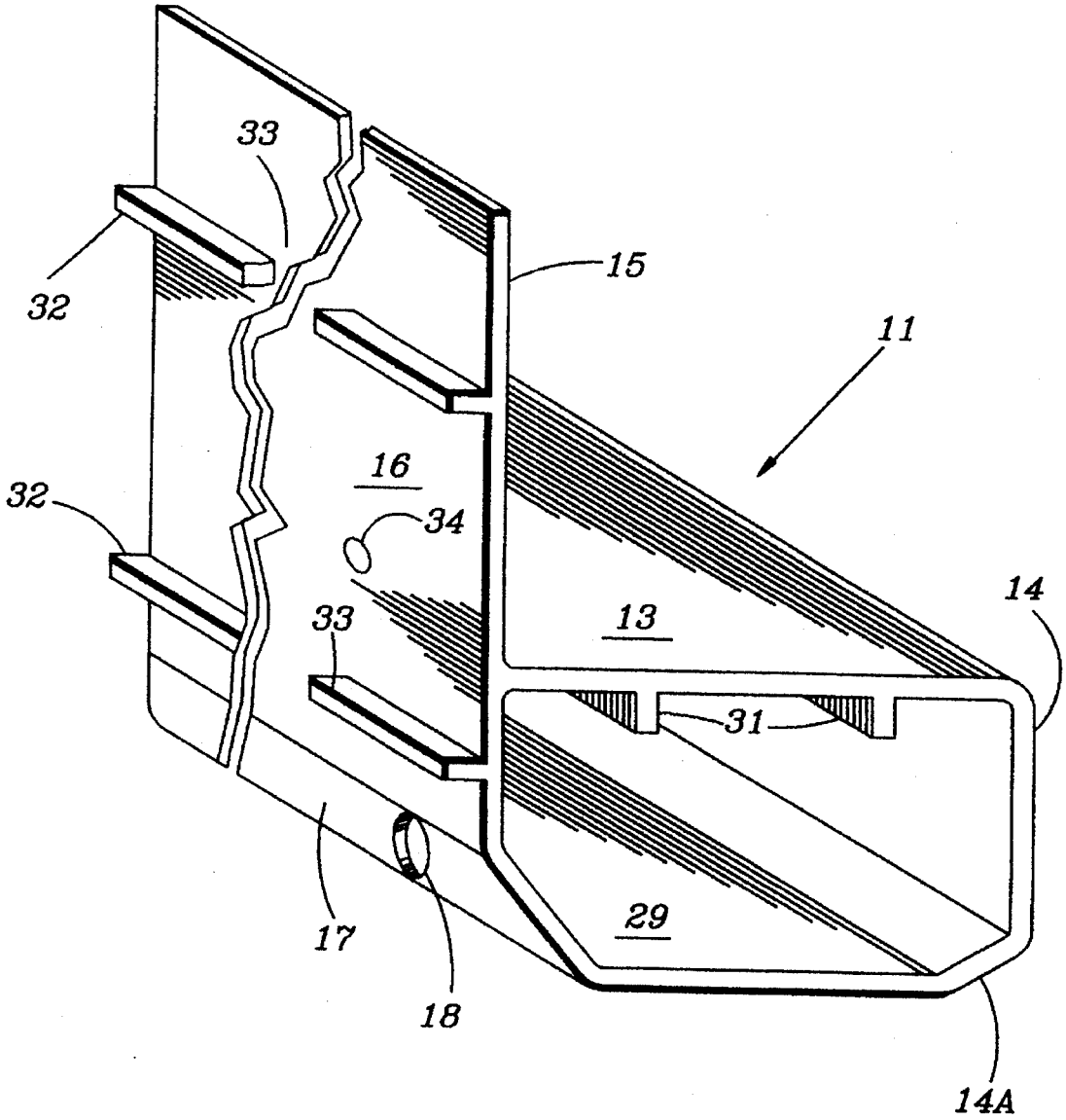
FIG. 2 is a perspective view of a section of drainage conduit according to a preferred embodiment of the present invention.

The structural features of the preferred embodiment of drainage conduit 10 according to the present invention are illustrated most clearly by FIG. 2. The flat roof wall 13 of the conduit 10 is formed with a spaced pair of interior longitudinal vertical ribs 31 which extend the length thereof and reinforce or strengthen the roof section 13 against distortion or deflection under the weight of the narrow peripheral edge of the concrete floor 24 applied thereover after installation, as illustrated by FIG. 1.

More important features of the drainage conduit 10 of FIG. 2, more particularly of the vertical upper wall portion 16 of the inner wall section 15, are spacer means comprising a space pair of segmented stand-off ribs 32 extending horizontally from the rear face of the wall portion 16 to space said rear face from the basement walls 23 by a distance, such as about ⅜", when installed. The segmented ribs 32 provide a plurality of spaced openings 33, one about every three inches, which permit any water which forms upon or penetrates the inside surface of the basement wall 23 to run down behind the conduit wall portion 16 and through the openings 33 in the stand-off ribs 32 to enter the water passage 29 and conduit inlet openings 18 for discharge. This feature adapts the present water control system and drainage conduits 10 for use with basement walls which have water leaking down them from condensation, cracks, mortar joints, pipe penetrations, window wells etc. to the basement floor 24, by providing a vertical drainage space along the wall/floor interface. The vertical upper wall 16 portion extends upward above the finished floor 24 to prevent the entry of dirt and debris and small objects from the surface of the floor 24, ensuring the preservation of the wall drainage space created.

FIGS. 1 and 2 also illustrate spaced attachment holes 34 through the upper vertical wall section 16, and masonry nails 35 therethrough for fastening the elongate sub-floor drainage conduit 10 to the basement wall 23 and holding it in place prior to and during the recementing of the peripheral edge of the basement floor 24 or prior to and during the laying of the cement floor 24, in the case of original construction. These holes may not be utilized in many installations if the drainage conduit is setting satisfactorily prior to pouring the floor, but they are small enough that no concrete will pass therethrough if they are not used for fastening and remain open.

Figure 3:
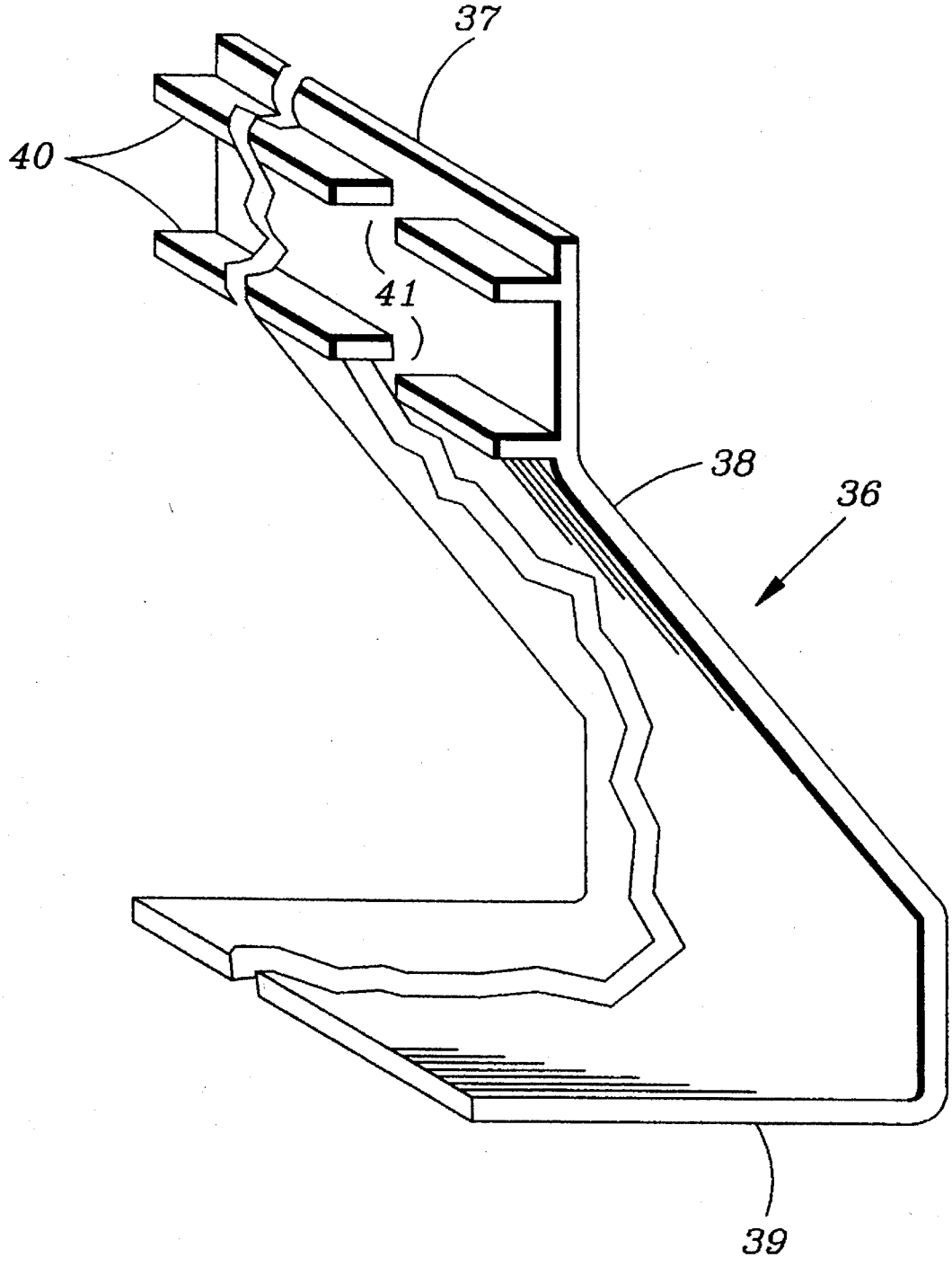
FIG. 3 is a perspective view of a section of drainage conduit according to another embodiment of the present invention.

The drainage conduit enclosure 36 according to the embodiment illustrated by FIG. 3 is a simplified structure which is capable of being extruded inexpensively and which does not require the after-step of forming water-inlet holes such as holes 18 of the embodiment of FIGS. 1 and 2.

The enclosure 36 of FIG. 3 comprises a vertical upper wall portion 37 integral with a lower semi-hemispherical conduit section having a wall portions 38 which extends outwardly and downwardly from the vertical upper wall portion 37 to a horizontal floor or base portion 39 which extends inwardly towards the wall/footing interface 36 on the top surface of the footing.

The inside surface of the upper wall portion is provided with spacer means similar to those illustrated in FIG. 2. Thus a spaced pair of integrated longitudinal ribs 40 are extruded in situ and thereafter provided with spaced openings 41 to permit vertical drainage of water therethrough down to the wall/footing interface for entry into the open conduit section, over the floor or base portion 39 and peripheral drainage to a drain hole, not shown, open to a disposal drain pipe. The semi-hemispherical conduit section, comprising the wall portion 38 and floor portion 39, substantially-retains the water admitted through or down the basement wall or through the wall/footing interface and substantially prevents such water from flowing freely outwardly from the wall and down beside the footing. Instead the conduit section channels the admitted water freely over the floor portion 39 and over the footing, peripherally to one or more drain openings.

The base wall or floor portion 39 need only extend a slight distance inwardly over the surface 27 of the footing 22 to support the conduit element 36 against the surface 27 and deter movement of the admitted groundwater outwardly towards the edge of the footing. Preferably the floor portion 39 extends nearly to the wall/footing interface, to provide a water-impervious floor for the conduit section.

The present drainage conduits preferably are extruded from suitable resinous or plastic compositions and in thicknesses which provide the necessary strength to resist collapse under the weight of the cement applied thereagainst. Preferred extrusion resins include polyvinyl chloride (PVC), polycarbonate, polyethylene terephthalate, nylon polyamides and similar compositions which will be apparent to those skilled in the extrusion art. The necessary water inlet holes 18, nail holes 34 and segmenting of the spacer flanges or ribs 32 are accomplished as after-steps.

It will be apparent to those skilled in the art, in the light of the present disclosure that the stand-off means used to space the rear face of the upper wall portions 16 and 37 from the basement wall can be in the form of any plurality of spaced studs, projections, vertical ribs or other features which extend a uniform short distance from said rear face to engage the basement wall and form the narrow drainage space.

It will also be apparent that the upper wall portion 16 of the inside wall 15 of the drainage conduit 10 need not be integral therewith but may be a separate elongate strip member carrying the stand-off or spacer means and designed to mate with or otherwise engage or interconnect with the tubular drainage conduit portion to function in the same manner as the integral drainage conduit 10 of the drawing.

It will be apparent to those skilled in the art that the novel drainage conduit system of the present invention represents a substantial improvement over prior-known sub-floor water control systems in that the present system requires substantially less floor jackhammering, removal and excavation to uncover and expose the required width of the upper ledge 27 of the footing 22, e.g., about 3½ inches, which is the overall width of the drainage conduits 10 of the drawing, including the stand-off ribs 32 and 40. This also reduces the quantity of concrete necessary to reconstruct the peripheral edges of the floor 24 over the installed system. The thickness of the concrete applied over the flat roof section 13 generally is about 1 to 2 inches and the height of the upper wall section 16 of the conduit 10, above the roof section 13 is about 2½ inches, and above the floor or base wall 12 is about 4⅜ inches. It will be apparent that drainage conduits 10 having upper wall sections 16 extending a greater distance above the roof section 13, will be required for use in installations in which the upper surface of the footing ledge 27 is located more than about 4¼ inches below the surface of the basement floor 24. Alternatively, upper wall section extensions can be provided which make engagement, such as tongue-in-groove engagement, with the upper edge of the wall section 16 to increase the overall height thereof.

It will be apparent for those skilled in the art that the novel drainage conduits of the present invention normally are installed on top of the footing, but they can also be installed with foundation construction types that have no footing or a footing much deeper from the top of the floor surface, by supporting the drainage conduits upon the soil, aggregate or other material which is found or introduced when the appropriate size excavation is made to install the drainage conduits.

It will be apparent to those skilled in the art that the present novel drainage conduits can be installed in new construction projects before the original floor is installed, or in existing structures where the periphery of the floor must be removed to install the drainage conduits.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

I claim:

1. An elongate water-conveying drainage conduit element designed to be installed in a subterranean room having an outer peripheral wall having a base supported on a footing and having a floor with outer peripheral edges which extend to the base of said wall and cover said footing, said drainage conduit element being designed to be substantially covered by the peripheral edges of said floor of said room, to receive groundwater admitted at said base and through areas of said wall above said base and to convey said groundwater to a remote drain, said drainage conduit element comprising a vertical upper wall portion which is designed to extend above the surface of said floor, adjacent the wall of said room, said vertical upper wall portion having a rear surface comprising uniform spacer means for engagement with the wall of said room to space the rear surface of the vertical upper wall portion from the wall of said room and provide therebetween a narrow drainage space to admit water flowing down the wall of said room, said vertical wall portion extending downwardly and outwardly, away from the vertical, to a horizontal base wall portion designed to engage the wall footing and support the conduit element thereon, said vertical and horizontal wall portions enclosing an elongate conduit section which is open to the admission of groundwater to convey said water peripherally through said drainage conduit element to one or more remote drains.

2. A drainage conduit element according to claim 1 comprising an integral extrusion of plastic composition.

3. A drainage conduit element according to claim 1 in which said vertical wall portion tapers downwardly and outwardly to said horizontal base wall portion.

4. A drainage conduit element according to claim 1 in which the spacer means present on the rear surface of the vertical wall portion comprise segmented horizontally-extending flanges.

5. A drainage conduit element according to claim 1 in which said vertical wall portion comprises a plurality of spaced through holes for receiving means for fastening the drainage conduit to the wall of said room.

6. An elongate water-conveying drainage conduit element designed to be installed in a subterranean room having an outer peripheral wall having a base and having a floor with outer peripheral edges which extend to the base of said wall, said drainage conduit element being designed to be substantially covered by the peripheral edges of said floor of said room, to receive groundwater admitted at said base and through areas of said wall above said base and to convey said groundwater to a remote drain, said drainage conduit element comprising an elongate tubular conduit section having a roof wall, an inside wall, an outside wall and a horizontal floor wall portion designed to support the drainage conduit element, adjacent the base of the wall of said room, said tubular conduit section inside wall having a lower wall portion which is recessed inwardly to said horizontal floor wall portion to form an exterior water passage when said drainage conduit is supported against the base of the wall of said room, said recessed lower wall portion being provided with a plurality of spaced water-inlet holes to admit groundwater from said exterior water passage into said tubular conduit section, said inside wall also having a vertical upper wall portion which extends above the roof wall of the conduit section for extension above the surface of the floor of said room, adjacent the wall of said room, the rear face of said vertical wall portion comprising uniform spacer means for engagement with the wall of said room to space the rear face of the vertical wall portion from the wall of said room and provide therebetween a narrow drainage space to admit water flowing down the wall of said room into said exterior water passage at the base of the wall of the room and through said spaced water-inlet holes into the tubular conduit section for drainage to a remote drain.

7. A drainage conduit element according to claim 6 comprising an integral extrusion of plastic composition.

8. A drainage conduit element according to claim 6 in which said conduit section lower wall portion tapers downwardly and inwardly to said conduit section floor wall to provide said exterior water passage.

9. A drainage conduit element according to claim 6 in which the spacer means present on the rear face of the vertical wall portion comprise segmented horizontally-extending flanges.

10. A drainage conduit element according to claim 6 in which said vertical wall portion comprises a plurality of spaced through holes for receiving means for fastening the drainage conduit to the basement wall.

11. A drainage conduit element according to claim 6 in which said roof wall is horizontal and comprises reinforcement means for strengthening said wall against the weight of said edges of the room floor.

12. A drainage conduit element according to claim 11 in which said reinforcement means comprises a plurality of longitudinal ribs or flanges extending downwardly along the underside of said roof wall.

13. An elongate water-conveying drainage conduit element designed to be installed in a subterranean room having an outer peripheral wall having a base supported on a footing and having a floor with outer peripheral edges which extend to the base of said wall and cover said footing, said drainage conduit element being designed to be substantially covered by the peripheral edges of said floor of said room, to receive groundwater admitted at said base and through areas of said wall above said base and to convey said groundwater to a remote drain, said drainage conduit element comprising an elongate tubular conduit section having a horizontal roof wall, an inside wall, an outside wall and a horizontal floor wall designed to engage said footing, to support the drainage conduit element on said footing, said tubular conduit section inside wall having a lower wall portion which is recessed inwardly to said horizontal floor wall to form an exterior water passage when said drainage conduit is supported at the base of the wall of said room, said recessed lower wall portion being provided with a plurality of spaced water-inlet holes to admit groundwater from said exterior water passage into said tubular conduit section, said inside wall also having a vertical upper wall portion which extends above the horizontal roof wall of the conduit section for extension above the surface of the floor of said room, adjacent the base thereof, the rear face of said vertical wall portion comprising uniform spacer means for engagement with the wall of the room to space the rear face of the vertical wall portion from the wall of the room and provide therebetween a narrow drainage space to admit water flowing down the wall of the room into said exterior water passage at the base of the wall of the room and through said spaced water-inlet holes into the tubular conduit section for drainage to a remote drain.

14. An elongate water-conveying drainage conduit element designed to be installed in a subterranean room having an outer peripheral wall having a base and having a floor with outer peripheral edges which extend to the base of said wall, said drainage conduit element being designed to be substantially covered by the peripheral edges of said floor of said room, to receive groundwater admitted at said base and through areas of said wall above said base and to convey said groundwater to a remote drain, said drainage conduit element comprising an elongate conduit section having a roof wall, an outside wall, a floor wall portion designed to support the drainage conduit section against a surface, adjacent the base of the wall, said tubular conduit section being open opposite said outside wall to admit groundwater into said conduit section, and a vertical upper wall portion which extends above the roof wall of the conduit section for extension above the surface of the floor of said room, adjacent the wall of the room, the rear face of said vertical wall portion comprising uniform spacer means for engagement with the room wall to space the rear face of the vertical wall portion from the room wall and provide therebetween a narrow drainage space to admit water flowing down the room wall into the tubular conduit section for drainage to a remote drain.

* * * * *